United States Patent [19]

Honegger et al.

[11] Patent Number: 4,981,291

[45] Date of Patent: Jan. 1, 1991

[54] DEVICE FOR THE COLLATION, INSERTION AND COLLECTION OF PRINTED PRODUCTS

[75] Inventors: Werner Honegger, Tann Ruti; Egon Hänsch, Wetzikon, both of Switzerland

[73] Assignee: Ferag AG., Winwil, Switzerland

[21] Appl. No.: 350,112

[22] Filed: May 9, 1989

[30] Foreign Application Priority Data

May 11, 1988 [CH] Switzerland ..... 01798/88

[51] Int. Cl.[5] ..... B65H 5/30

[52] U.S. Cl. ..... 270/55; 270/54

[58] Field of Search ..... 270/54, 55, 57, 58

[56] References Cited

U.S. PATENT DOCUMENTS

| | | | |
|---|---|---|---|
| 3,951,399 | 4/1976 | Reist . | |
| 4,058,202 | 11/1977 | Reist et al. . | |
| 4,398,710 | 8/1983 | Hansch . | |
| 4,408,754 | 10/1983 | Meier | 270/57 |
| 4,408,755 | 10/1983 | Meier . | |
| 4,489,930 | 12/1985 | Meier . | |
| 4,684,116 | 8/1987 | Hansch . | |
| 4,684,117 | 8/1987 | Honegger et al. . | |
| 4,706,951 | 11/1987 | Leu . | |
| 4,709,910 | 12/1987 | Honegger | 270/55 |
| 4,735,406 | 4/1988 | Weber . | |

FOREIGN PATENT DOCUMENTS 641113 2/1984 Switzerland .

*Primary Examiner*—Edward K. Look
*Assistant Examiner*—Therese M. Newholm
*Attorney, Agent, or Firm*—Willian Brinks Olds Hofer Gilson & Lione

[57] ABSTRACT

A star feeder type of drum (12) has pocket-shaped compartments (14) and saddle-type supports (46) disposed alternately about a common axis of rotation. Each compartment (14) contains a carriage which is guided in a rail (44) and has a bottom (86) and at least one clamp (54). The clamp (54) is controlled independently of the movement of the carriage by shifting a rail section (56). For collation and insertion, printed sheets (34) are fed into the compartments (14) at a first feed point. These printed sheets (34) are seized by the appropriate clamps (86) during the rotation of the drum (12) in the direction of the arrow (U) and are conveyed to the next feed point, where further printed sheets (34) are fed into the compartments (14). In the course of further revolutions the printed sheets (34) thus collated or inserted are conveyed to a removal point. During collection the printed sheets (34) are placed astride the supports (46), so that each printed sheet (34) is held by each of its halves extending into a compartment (14) by a clamp (54) for conveyance along the supports (46) during rotation in the direction of the arrow (U).

15 Claims, 7 Drawing Sheets

DEVICE FOR THE COLLATION, INSERTION AND COLLECTION OF PRINTED PRODUCTS

BACKGROUND OF THE INVENTION

The present invention relates to a device for the collation, insertion and collection of printed products.

Drum-type insertion and collation devices are known from, for example, CH Patent Specification Nos. 584,153 and 575,303 or the corresponding U.S. Pat. Nos. 3,951,399 and 4,058,202. They have several pocket-shaped accommodation parts which are disposed in the form of a star feeder around a common axis of rotation and with their lengthwise extension running in the direction of the axis of rotation. In the direction of the axis of rotation, provision is made for several feed stations which are spaced apart and which insert printed products into the accommodation parts. By means of clamping arrangements allocated to each accommodation part, the inserted printed products are held fast in the course of the revolutions about the axis of rotation and are conveyed from one feed station to the next and finally to a removal station, where the printed products which have been collated or inserted into each other are conveyed away. The clamping arrangements can be designed in such a way that the one side boundary of each accommodation part is designed as a roller track, against which the inserted printed products are pressed by means of roller-type rotary clamps. Each accommodation part can have allocated to it a carriage which in the course of a revolution about the axis of rotation carries out a conveyance and a return stroke, and which has clamps on its bottom to clamp the printed products resting on the bottom to the carriage during the conveyance stroke.

A collection drum having saddle-type supports disposed about a common axis of rotation is also disclosed, for example in DE-OS 36 20 945 or the corresponding U.S. Pat. No. 4,684,116. Each support has allocated to it a rotary conveyor element with support elements and carriers for conveying the folded printed sheets deposited astride the support elements towards the axis of rotation in the course of the rotations of the supports about the axis of rotation. In addition, EP-OS 0,208,081 and the corresponding U.S. Pat. No. 4,684,117 describe a feed station with which the infed folded printed sheets can be opened and placed on the support elements. The printed sheets thus placed on top of each other and collected along the processing line are lifted from the support elements by means of a removal station and are conveyed away.

Another device for the collection of folded printed products is known from EP-OS 0,095,603 and the corresponding U.S. Pat. No. 4,489,930, in which a multiplicity of saddle-type supports are disposed like the rungs of a ladder on two parallel-rotating conveyor chains. Provision is made along the conveying upper track for several feed stations which are connected in series and which place folded printed products astride the supports. At the end of the conveying stretch the collected printed products thus placed on top of each other are lifted from the supports by means of a removal station and are conveyed away.

Another device for the collection of folded printed sheets is known from, for example, DE-OS 36 16 566 and the corresponding U.S. Pat. No. 4,735,406. It has three rotary saddle-type supports disposed parallel to a common axis of rotation and rotating about the latter. In the direction of the axis of rotation provision is made in succession for two feeders for placing printed sheets on the supports and a stapler for stapling together the printed sheets lying on top of one another. The printed sheets thus collated and stapled slide onto a conveyor belt for discharge. Each support is provided with an endless rotating chain with carriers which act upon the printed sheets placed on the supports and while the supports are rotating about the common axis of rotation convey said sheets from one feeder to the other or to the stapler. Baffle plates are provided on either side of each support to prevent the printed sheets from spreading out. In order to prevent the printed sheets from falling off the supports while they are being moved along below the axis of rotation, provision is made for a half cylindrical surface on which the printed sheets slide with their fold during the lower half of the rotary movement.

Each of these known devices is suitable for either collection or insertion and collation of printed products. In order to be able to carry out all these activities, printing shops and printed products processing works, such as bookbinding businesses, must be equipped with the appropriate devices and machines.

It is therefore an object of the present invention to extend the uses of the known devices and thus to reduce the multiplicity of different devices and machines needed in printing shops and printed products processing works.

SUMMARY OF THE INVENTION

According to this invention, a device is provided for the collation, insertion and collection of printed products. This device can include a plurality of pocket-shaped accommodation parts for the collection or insertion of printed products travelling along a processing path. Each of these accommodation parts has a lengthwise extension running crosswise to the processing path, and the accommodation parts are spaced apart from one another to convey printed products fed into the accommodation parts at at least two feed points spaced along the processing path to a removal point. The device also can include a plurality of saddle-shaped supports oriented transversely to the processing path for the collection of printed products placed astride the supports at the feed points. Means are provided for mounting the accommodation parts and the supports on the device and for moving the accommodation parts and the supports along the processing path. Means are also provided for clamping printed products resting in the accommodation parts at least while the printed products are passing through a section of the processing path in which the accommodation parts are directed downwardly and for clamping printed products astride the supports at least while the printed products are passing through a section of the processing path in which the supports are directed downwardly.

Printed products can thus be collected, inserted and collated with a single device which can include both accommodation parts and supports. The accommodation parts and supports can be fixed on the device. It is, however, also conceivable for the accommodation parts to be interchangeable with the supports, so that the device can be retooled for either collection or insertion and collation of printed products. It is also possible for the accommodation parts and/or the supports to be detachable, so that again after a short retooling time printed products can be collected, inserted or collated with the device.

In a particularly simple embodiment of the device, the same clamping devices are used to clamp the printed products fed into the accommodation parts and the printed products placed astride the supports.

In the preferred embodiment the accommodation parts and supports are arranged alternately, viewed in the direction of rotation. In this embodiment the clamping arrangements allocated to the accommodation parts can hold the printed products fed into said parts. The same clamping arrangements can, however, also clamp the printed product halves of printed products placed on the supports extending into the accommodation parts.

In another embodiment a preferably detachable support is provided approximately in the center of each accommodation part. When, for example, the supports are removed, the accommodation parts and their clamping arrangements can be used for the conveyance of the printed products fed into the accommodation parts. When, on the other hand, the supports are fitted, the printed product halves of the printed products placed astride the supports go into the accommodation parts and are held fast by the clamping arrangements.

A particularly high processing capacity with the minimum of space requirements is achieved with a particularly preferred embodiment of the device in which the accommodation parts and the supports are mounted for rotation about a horizontal axis, as described below.

Further advantageous features are described in the following detailed description and defined in the claims.

DETAILED DESCRIPTION OF THE PRESENTLY PREFERRED EMBODIMENTS

Figure 1:
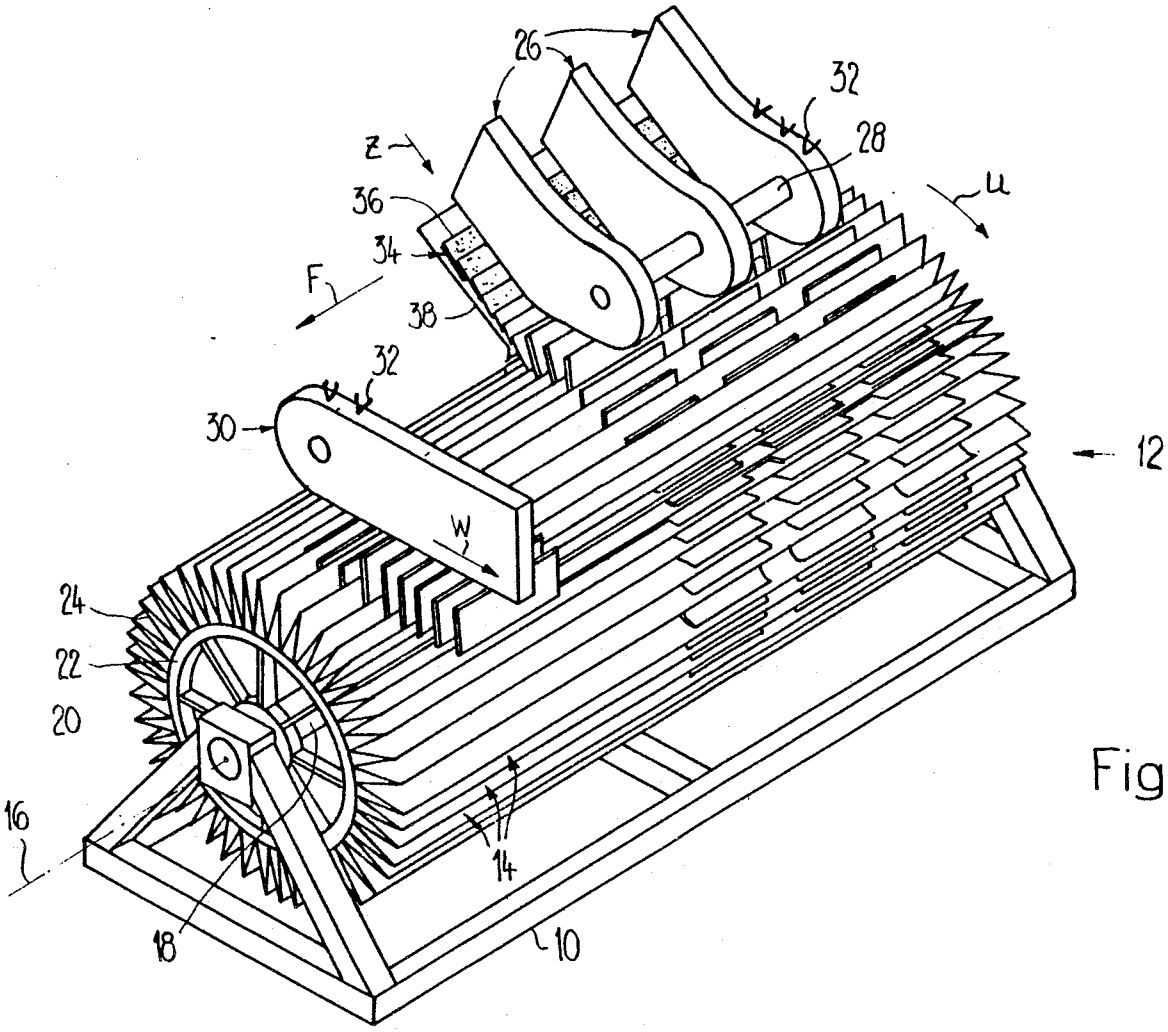
FIG. 1 shows a perspective view of an example of an embodiment of a collating drum.

The invention is now explained in greater detail with reference to an example illustrated in the drawing. The device concerned is a drum with accommodation parts and supports disposed alternately in series, which is suitable for the collation, insertion and collection of printed products. The layout of the drum in connection with collation is first explained, and the use of the drum for insertion and collection is then described.

FIG. 1 shows a rotary star feeder type of collating drum 12 rotatably mounted on a frame 10 and having a multiplicity of pocket-shaped compartments 14 which extend in the lengthwise direction of the drum 12, and which rotate jointly about an axis of rotation 16 in the direction of the arrow U. The frame 10 has disposed on it a hollow shaft 18 whose longitudinal axis coincides with the axis of rotation 16. Rotatably mounted on the hollow shaft 18 are spoked wheels 20 spaced apart in the axial direction (only one of which can be seen in FIG. 1). Partitions 24, projecting radially outwards and running in the lengthwise direction of the drum 12, are fixed on the rims 22 of the spoked wheels 20 and separate the compartments 14 from each other, viewed in the direction of rotation U.

Three schematically shown feed conveyors 26, spaced apart in the direction of the axis of rotation 16, are provided above the drum 12 and can be driven in synchronism by means of a common drive shaft 28. A discharge conveyor 30, which is also shown only schematically, is disposed in an end area of the collating drum 12, viewed in the direction of the arrow F. The feed conveyors 26 have disposed on a traction element (not shown) rotating in the feed direction Z individually controllable grippers 32, which are also shown only schematically. Such feed conveyors 26 are generally known and can be constructed, for example, in the same way as or similar to the feed conveyors shown in EP-OS 0,218,872 or the corresponding U.S. Pat. No. 4,706,951. It would also be conceivable to design the feed conveyors 26 in the way disclosed in CH-PS 575,303 or the corresponding U.S. Pat. No. 4,058,202. Each of the grippers 32 conveyed to the collating drum 12 seizes a printed sheet 34 at its rear edge 36, viewed in the feed direction Z. A baffle plate 38, running essentially parallel to the feed direction Z, and disposed below the feed conveyor 26, is mounted before the drum 12 and inserts the leading edges of the printed sheets 34 sliding along it into the relevant compartments 14.

The discharge conveyor 30 also has grippers 32 disposed on a rotary traction element (not shown) which is driven in the discharge conveyance direction W, said grippers seizing and carrying away the collated printed sheets 34. A similar discharge conveyor is described in greater detail in, for example, CH-PS 584,153 or the corresponding U.S. Pat. No. 3,951,399.

Each printed sheet 34 held by a gripper 32 of the feed conveyors 26 is fed by the baffle plate 38 into a compartment 14 of the collating drum 12 and is dropped by the gripper 32 once the latter has reached an approximately vertical position above the axis of rotation 16. The printed sheets thus dropped come to rest on the floor of the particular compartment 14. Thus, the first feed conveyor 26, viewed in the direction of the arrow F, conveys a printed sheet 34 into each compartment 14 passing below this feed conveyor 26 in the course of the revolutions of the drum 12 in the direction of rotation U. In the course of a revolution of the drum 12 these printed sheets 34 are conveyed in the direction of the arrow F along a spiral path to the next feed conveyor 26, which also feeds another printed sheet into each compartment 14 next to each printed sheet 34 already in it, and these are then in each case conveyed together in the course of the next revolution of the collating drum 12 to the next feed conveyor 26. This is repeated until, as shown in FIG. 1, for example, three printed sheets 34 are lying side by side. In the course of two further revolutions the printed sheets 34 thus collated are conveyed to the discharge conveyor 30, where they are seized by it and taken away. In the region between the feed conveyors 26 and the discharge conveyor 30 the printed sheets 34 lying side by side can be subjected to further processing operations as desired.

Figure 2:
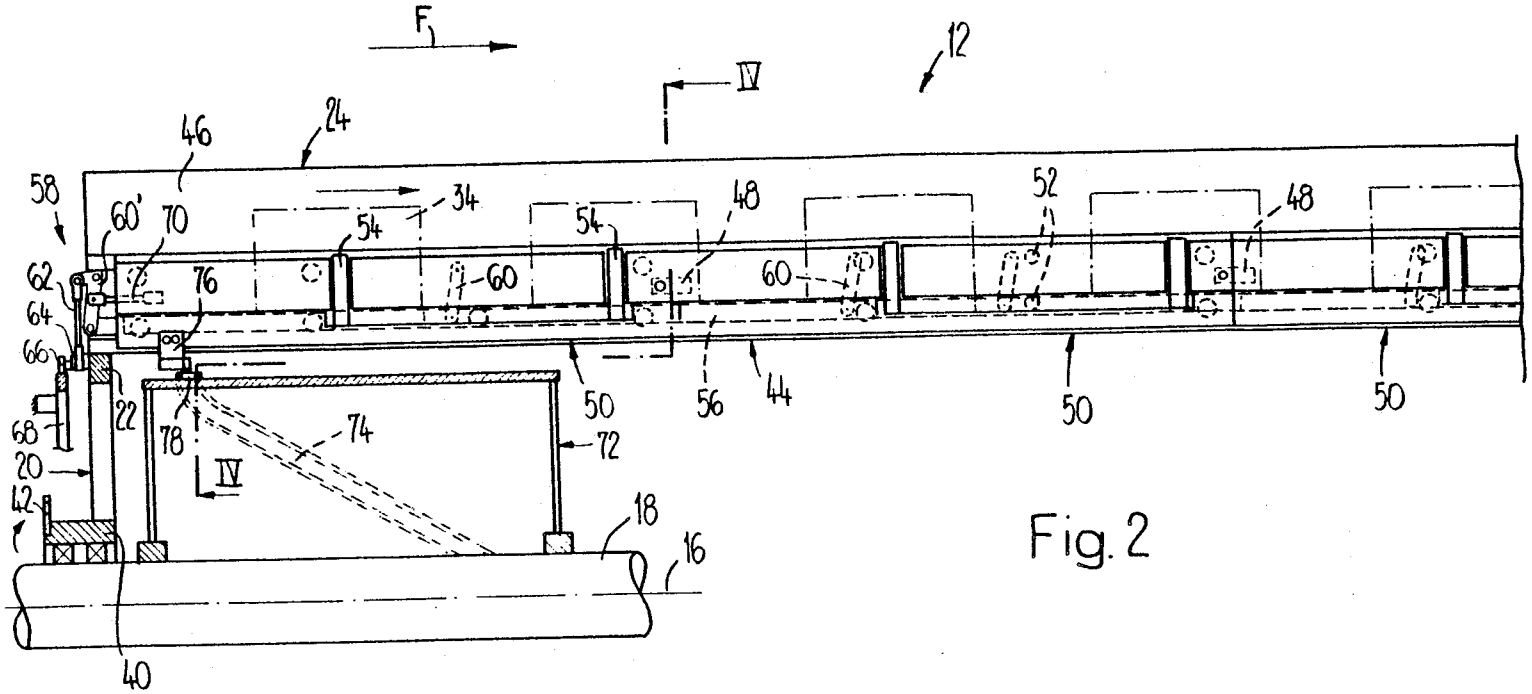
FIG. 2 shows a part of the collating drum in a longitudinal section.

FIG. 2 shows a part of the collating drum 12 in a longitudinal section. The one spoked wheel 20 visible in FIG. 2 is rotatably mounted on the hollow shaft 18, and has on its hub 40 a non-rotating chain wheel 42 of a chain drive which is operatively connected to a drive motor (not shown). The drum 12 is driven in the direction of rotation U by means of this drive motor (cf. FIG. 1). One end of a rail 44 which is C-shaped in cross section is fixed on the rim 22, said rail running in the lengthwise direction of the collating drum 12 and together with the support 46 fixed on it forming a partition 24. All partitions 24 shown in FIG. 1 are constructed in the same way as the partition 24 shown in FIG. 2. Three carriages 50 which are connected to each other by means of coupling elements 48, and which can be seen in this FIG. 2, are guided in the rail 44. Each carriage 50 has three or two guide roller pairs 52 which pivot thereon and run in the rail 44. Two clamping tongues 54 are mounted so that they swivel on each carriage 50, and they can be taken from their open position into the closed position and back by means of coupled rail sections 56 of a control device 58. This is described in greater detail further on.

Each rail section 56 is mounted, like a parallel crank gear, on two parallel rocking levers 60, which for their part are mounted in swivel fashion on the rail 44. The rocking lever shown on the left end of the rail 44 and indicated by 60' is designed as an angle lever and is operatively connected by means of a piston rod 62 to a twin-armed control lever 64 which is mounted in swivel fashion on the rim 22, and at the other end of which a follower roller 66 is rotatably mounted and for its part rolls along a guide face of a fixed link 68. A compression spring 70 fixed at one end to the rail 44 and acting at the other end of the rocking lever 60' presses the follower roller 66 against the guide face of the link 68 and at the same time pretensions the clamping tongues 54 towards the open position.

Viewed in the direction of the arrow F, provision is made in the initial area of the collating drum 12 for a coaxial control cylinder 72 which is disposed in a rotation-free manner on the usually stationary hollow shaft 18 and whose cylindrical surface, viewed in the radial direction, is a distance inwards from the rails 44. Disposed on the cylindrical surface is a self-contained control link 74, similar to an ellipse, which rotates about the control cylinder 72, and which, viewed in the direction of the axis of rotation 16, has in each of the end regions a sharp curve and between these end regions in each case a region with constant gradient as regards the direction of rotation U (in FIG. 2 only part of the control link 74 is shown).

Of all the carriages 50 guided in a rail 44 only the one in the region of the control cylinder 72 has a stirrup 76 by means of which it is connected to an adjacent carriage 50, viewed in the direction of rotation U. A carrier 78 disposed on the stirrup 76 runs in the control link 74 on the control cylinder 72. Dashed and dotted lines show printed sheets 34 standing in line on the bottom of the carriages 50, held fast by the clamping tongues 54 and, viewed in the direction of conveyance F, starting from the left, the first three printed sheets 34 shown in FIG. 2 essentially corresponding to the position of the feed conveyors 26 (cf. FIG. 1). In this way a single printed sheet 34 fed in by the first feed conveyor 26 is held fast by the first clamping tongue 54, in the case of the second clamping tongue 54 there are two identical adjacent printed sheets 34, the second one having been fed in by the second feed conveyor 26, and in the case of the third clamping tongue 54 there are three of them, the third one having been fed in by the third feed conveyor 26. Each of the subsequent clamping tongues 54 also clamps three each of the adjacent printed sheets 34.

Figure 3:
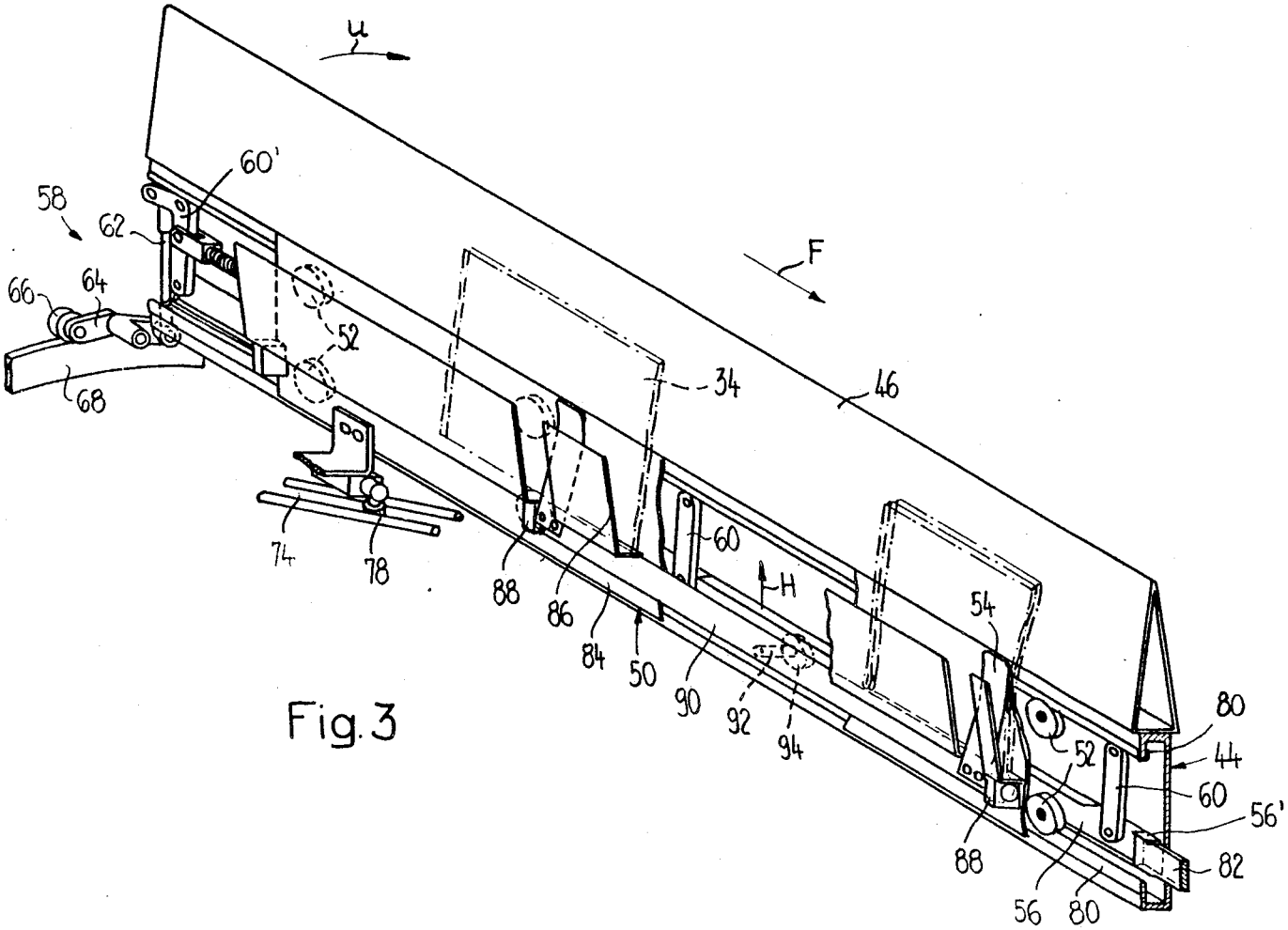
FIG. 3 shows a part of FIG. 2 in perspective, and simplified.

In FIG. 3 part of the left half of FIG. 2 is shown in perspective and on an enlarged scale, the carriage 50 being shown partially cut away. The same parts are indicated by the same reference numbers as in FIG. 2. These are discussed only insofar as is necessary for understanding FIG. 3. The ends of the C-shaped rail 44 facing each other each have a guide profile 80, for example made of plastic. The rollers of the guide roller pairs 52 rotatably mounted on the carriage 50 are made concave, so that they partially grip the guide profile 80 and give the carriages 50 a certain hold in a direction at right angles to the rail 44. The rail 44 has rotatably mounted on it the rocking levers 60, 60', whose free ends are connected to the rail section 56 in such a way that they swivel. The rail section 56 is also C-shaped in cross section, in the region of the rocking levers 60, 60' the upper flank 56' being always excluded. Reference number 82 indicates the connecting piece connecting the rail section 56 to the next rail section 56, viewed in the direction F. When the rocking levers 60, 60' are swung from the position shown in FIGS. 2 and 3 in the clockwise direction, the rail section 56 makes a movement like the couple of a parallel crank gear and thus also a stroke movement in the direction of the arrow H, i.e., in the radial direction outwards. This movement of the rail section 56 is controlled by the follower roller 66 sliding on the link 68, the movement of said roller being transmitted by means of the control lever 64 and the piston rod 62 to the rocking lever 60' designed as an angle lever.

The carriage 50 has a flat wall element 84 on which the guide roller pairs 52 are mounted. On the wall element 84, at the side facing away from the rail 44, there is provided an upward bent guide element 86 which forms a pocket with a bottom, and which is cut out in the region of the clamping tongues 54. The clamping tongues 54, which are preferably made of spring steel, are fixed to a shaft 90 swivelably mounted by means of bearing elements 88 on the wall element 84 and running in the lengthwise direction of the rail 44. The upward-projecting free ends of the clamping tongues 54 can bear clamping supports, for example made of rubber. A lever arm 92 projecting towards the rail section 56 is fixed on the shaft 90 approximately in the center, between the two clamping tongues 54, on the free end of which arm a roller 94 guided in the C-shaped rail section 56 is rotatably mounted. When the carriage 50 is moved in the direction of the arrow F or in the opposite direction the roller 94 slides in the rail section 56, and when the rail section 56 is raised or lowered in the direction of the arrow H or in the opposite direction the two clamping tongues 54 are swung into the open or closed position. During rotation of the rail 44 together with the support 46 and the carriage 50 in the direction of the arrow U the carriage 50 makes a conveyance stroke in the direction of the arrow F and in the opposite direction a return stroke according to the control link 74 in which the carrier 78 is sliding. In this figure also, as in FIG. 2, the individual printed sheets 34, or those deposited side by side on the bottom of the guide element 86, are shown by dotted and dashed lines (the printed sheets 34 shown on the right in FIG. 3 are shown cut off on the righthand side).

Figure 4:
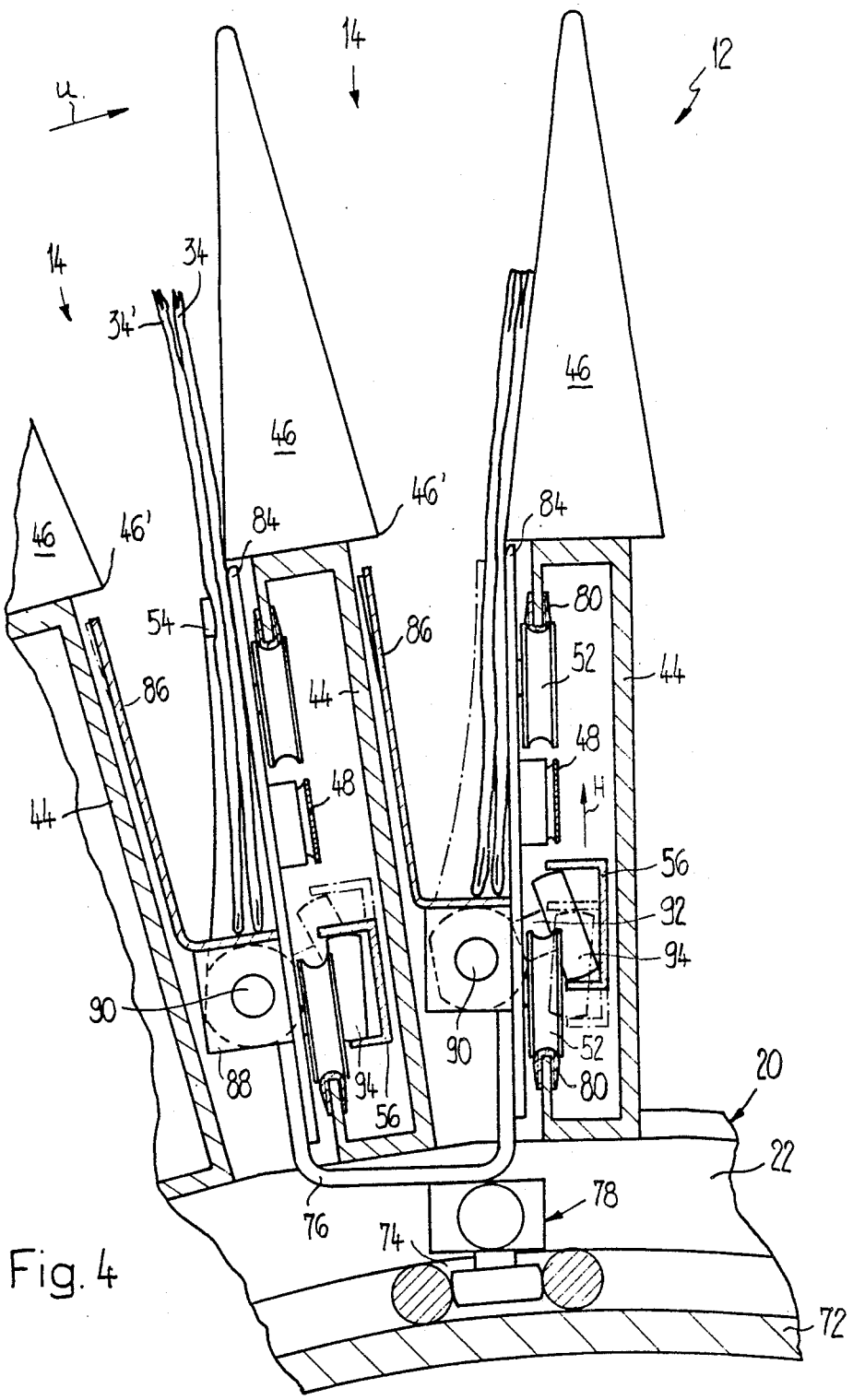
FIG. 4 shows an enlarged view of a section along line IV—IV of FIG. 2.

FIG. 4 shows a section along the line IV—IV of FIG. 2 through several compartments 14 of the collating drum 12 (cf. FIG. 1). The rails 44 are fixed on the rim 22 of the spoked wheel 20 (see FIGS. 1 and 2), and the supports 46 which are saddle-shaped in cross section rest on them directed radially outwards. Disposed on the opposite-facing ends of each rail 44 are the guide profiles 80, on which the guide roller pairs 52 are guided. The guide roller pairs 52 are rotatably mounted on the relevant wall element 84, and the guide element 86 and the bearing elements 88, only one of which can be seen in FIG. 4, are fixed on said wall element. It should be noted that the upper end of the guide element 86, viewed in the direction of rotation U, extends behind the leading edge 46' of the following support 46. The upper end of the wall element 84 is also covered by the corresponding support 46, so that the printed sheets 34, 34' when inserted into the pocket formed by the wall element 84 and the guide element 86 can come to rest without any problem on its bottom and thus in the region of the clamping tongues 54. The clamping tongues 54 are fixed on the shafts 90 fitted on the bearing elements 88, from which shafts the lever arms 92 project towards the rail section 56. Rotatably mounted on the free end of each lever arm 92 is a roller 94 which is guided in the appropriate rail section 56, and has a convex bearing surface. The suspension and actuation devices for the rail sections 56 are not shown in this figure. The rail section 56 shown on the right in FIG. 4 is in arrow direction H in the upper outer end position, in the radial direction, so that the clamping tongues 54 concerned are in their open position, in which the free ends of the clamping tongues 54, viewed in the direction of rotation U, come to rest behind the guide element 86. The rail section 56 shown in this figure on the left is in the lower, radially inner end position opposite to the direction of the arrow H, so that the appropriate clamping tongues 54 are taken into the closed position, in which they clamp the printed sheets 34 between them and the end stop formed by the wall element 84. The opposite positions of the clamping tongues 54, rails 44 and rollers 94 are indicated by dashed and dotted lines in each compartment 14.

It should be noted that the two carriages 50 shown in this FIG. 4 are operatively connected to each other by means of the stirrup 76, but that the rail sections 56 of these two carriages 50 can be controlled independently of each other. It can be seen particularly clearly from this figure that the carrier 78 has a roller which is guided on two round profiles which are disposed parallel to each other on the control cylinder 72, and have a circular cross section, and whose opposite-facing surfaces form the control link 74. Reference number 48 indicates the coupling elements by means of which the carriages 50 guided in a rail 44 are coupled together (cf. FIG. 2).

Figure 5:
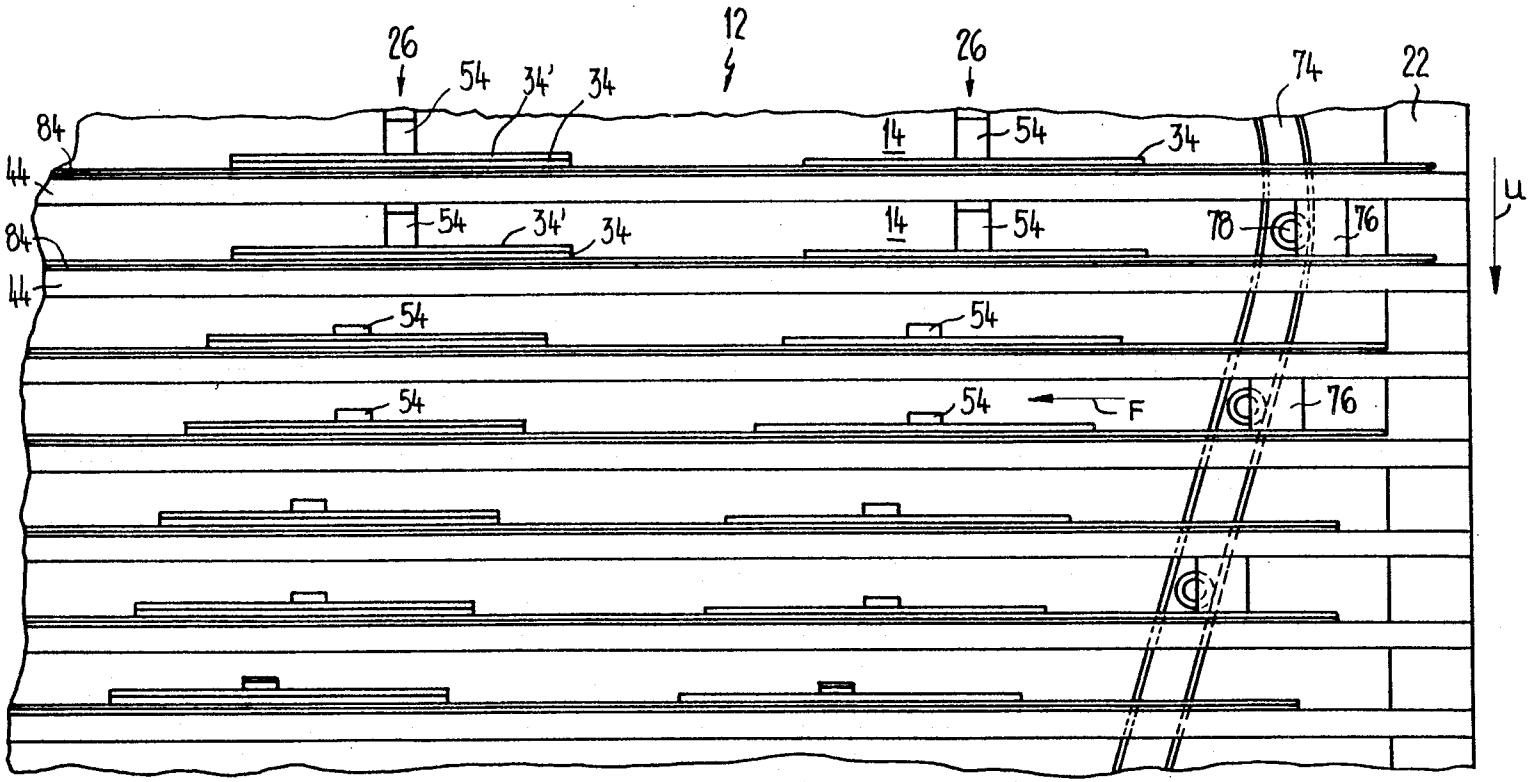
FIG. 5 shows the layout of a part of the conveyor line for printed sheets.

FIG. 5 shows the layout of that part of the conveyance route of the printed sheets 34, 34' which, viewed in the direction of rotation U, follows the first two feed conveyors 26 in the direction of the arrow F in FIG. 1. In FIG. 5 these two feed conveyors are indicated by arrows 26. For the sake of a better overall view, the layout of the collating drum 12 is shown greatly simplified. For example, the supports 46 disposed on the rails 44 are not shown. Likewise, only the wall elements 84 and clamping tongues 54 of the carriages 50 are shown. On the stirrups 76 connecting every two carriages 50 or their wall elements 84 to each other the carriers 78 which slide in the fixed control link 74 are shown. It should be noted that the clamping tongues 54 of the wall elements 84 connected in each case by means of a stirrup 76, viewed in the direction of the arrow F, are at the same height. The direction of rotation is indicated by U.

The collating drum 12 shown in FIG. 1 to 5 works as follows: the first feed conveyor 26, viewed in the direction of the arrow F, conveys a printed sheet 34 into each compartment 14 passing below it in the direction of the arrow U. When the clamping tongues 54 are in the open position this sheet falls onto the floor of the relevant carriage 50. In the course of further rotation in the direction of the arrow U the clamping tongues 54 are taken into the closed position, which causes the printed sheet 34 in question to be clamped between the clamping tongue 54 and the wall element 84 and to be carried along in the conveyance direction F according to the control link 74. A spiral conveyance route is thus formed to the next feed conveyor 26, and the conveyance stroke takes place in the direction of the arrow F essentially while the lower half of the conveyance route is being passed through (cf. FIG. 1). As soon as a compartment 14 reaches the upper region of the trajectory in the course of a revolution, the appropriate clamping tongues 54 are taken into the open position and the return stroke opposite to arrow direction F is introduced for the carriages 50 in question. On further rotation of the collating drum 12 in the direction of arrow U these printed sheets 34 therefore arrive at the second feed conveyor 26, where the latter deposits a second printed sheet 34' into each compartment next to the printed sheets 34 already present (see in particular FIG. 5). The two printed sheets 34, 34' thus next to each other are now gripped in the course of further rotation by the closing clamping tongues 54, and in the course of a revolution are conveyed to the third feed conveyor 26, where in a similar manner a third printed sheet 34 is added. In the course of two further revolutions in the direction of arrow U these three printed sheets 34, 34' lying next to each other in each case are conveyed to the discharge conveyor 30, where they are seized by the grippers 32 and carried away in the direction of the arrow W (cf. FIG. 1).

In order to be certain to prevent the printed sheets 34, 34' from being carried along in the opposite direction to the arrow F during the return stroke of the carriages 50, provision can be made in each compartment 14, for example on the supports 46, for swivel-mounted arms which during conveyance of the printed sheets 34, 34' in the direction of the arrow F are swung back by said sheets, but which in the case of any movement of the printed sheets 34, 34' opposite to the direction of the arrow F stand in their way. Such arms are known, for example from CH-PS 575,303 or the corresponding U.S. Pat. No. 4,058,202 already mentioned above. It should be noted that during collation the printed sheets 34, 34' may be folded or not folded. It is also possible for the printed sheets 34, 34' fed in by one feed conveyor 26 to be folded, and the printed sheets 34, 34' fed in by another not to be folded.

Each of the printed sheets 34 and 34' shown in FIGS. 1 to 4 are made up of several folded single sheets, which are fed fold first to the collating drum 12.

Figure 6:
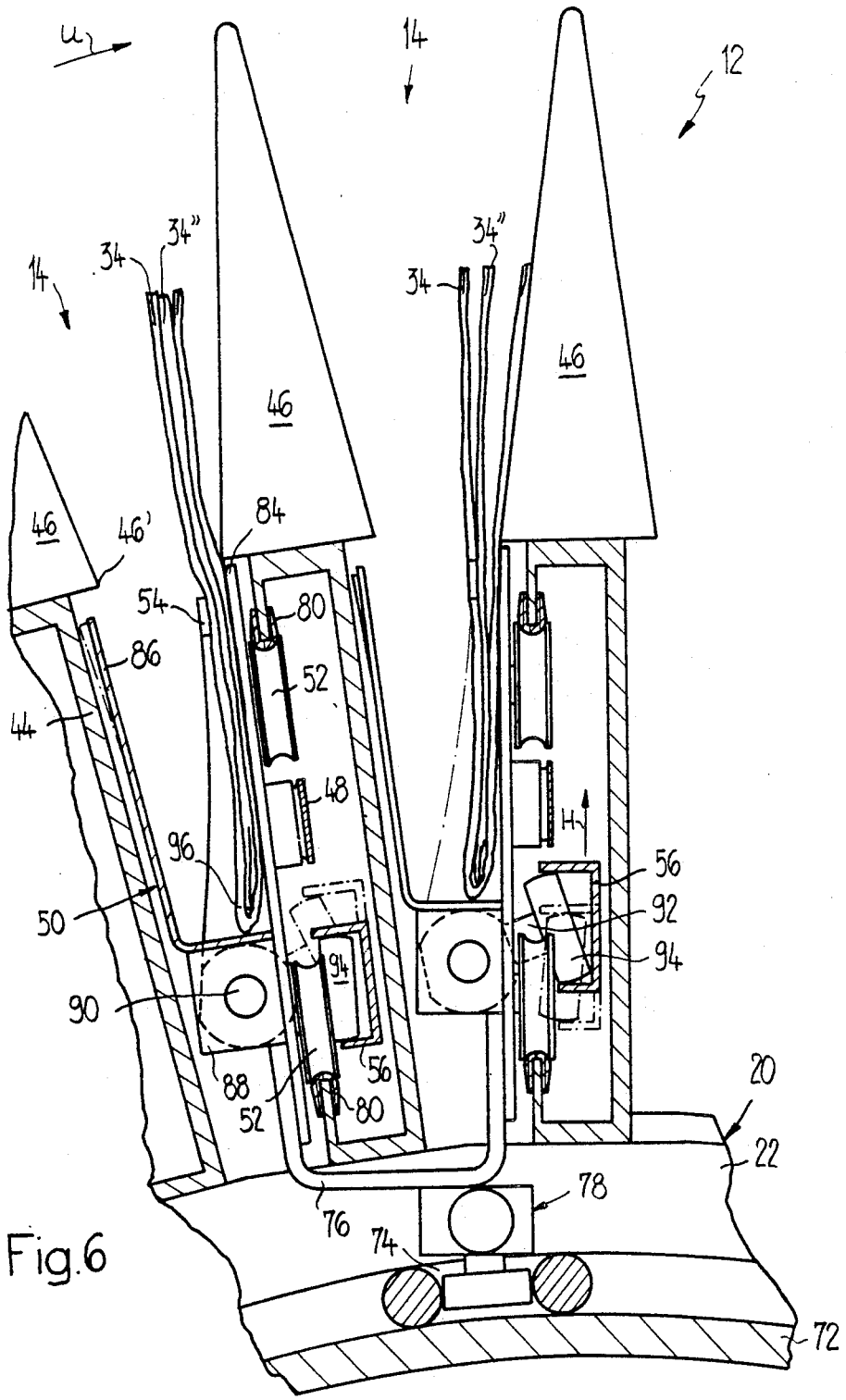
FIGS. 6 and 7 show an insertion or collection drum in the same view as FIG. 4.

FIG. 6 shows the same drum 12 in the same way as in FIG. 4, but here further printed sheets 34'' are inserted into a folded printed sheet 34 fed in first. In this case it is therefore an insertion drum 12 which is involved. For the detailed description of this FIG. 6 you are referred to FIG. 4 and the description of it, since the layout of the device in these two figures is the same. In a similar manner to the collating drum 12 described further back, the insertion drum 12 (FIG. 6) operates as follows: the first feed conveyor 26 (FIG. 1), viewed in the direction of the arrow F, conveys a folded printed sheet 34, fold 96 (FIG. 6), first into each compartment 14. When the grippers 32 open, the printed sheet 34 falls onto the floor of the compartment 14 formed by the guide element 86, while the clamping tongues 54 are in the open position. In the course of further rotation in the direction of rotation U the appropriate clamping tongues 54 are taken into the closed position, before the appropriate compartment runs into the lower half of the trajectory, so that the folded printed sheet 34 is held fast between the wall element 84 and a clamping tongue 54. While the lower half of the trajectory is being passed through, the carriage 50 is conveyed together with the printed sheets 34 in the direction of arrow F into the region of the second feed conveyor 26 (see FIG. 1). In the course of this conveyance movement the folded printed sheets 34 are opened by means of an opening device of the type described in, for example, CH-PS 641,113 or CH-PS 644,814 or the corresponding U.S. Pat. No. 4,398,710. When they enter the appropriate compartment 14 again in the region of the upper half of the trajectory, the clamping tongues 54 are opened, and a printed sheet 34'', which may or may not be folded, is then inserted into the opened, folded printed sheet 34 by the second feed conveyor 26. In the course of the next revolution the printed sheets 34, 34'' thus inserted into each other are held fast by the clamping tongues 54 and conveyed to the third feed conveyor 26, where in a similar manner a second printed sheet 34'' is inserted. This second sheet 34'' can be inserted into the folded printed sheet 34 either beside or in the also opened first sheet 34''. The printed sheets 34, 34'' thus inserted into each other are conveyed in the course of two further revolutions in arrow direction U to the discharge conveyor 30, where they are seized by its grippers 32 and transported away. As in the case of the collating drum, the insertion drum 12 can also be provided with arms, in order to prevent the printed sheets 34, 34'' from running back in the opposite direction to arrow F during the return stroke of the carriages 50.

Figure 7:
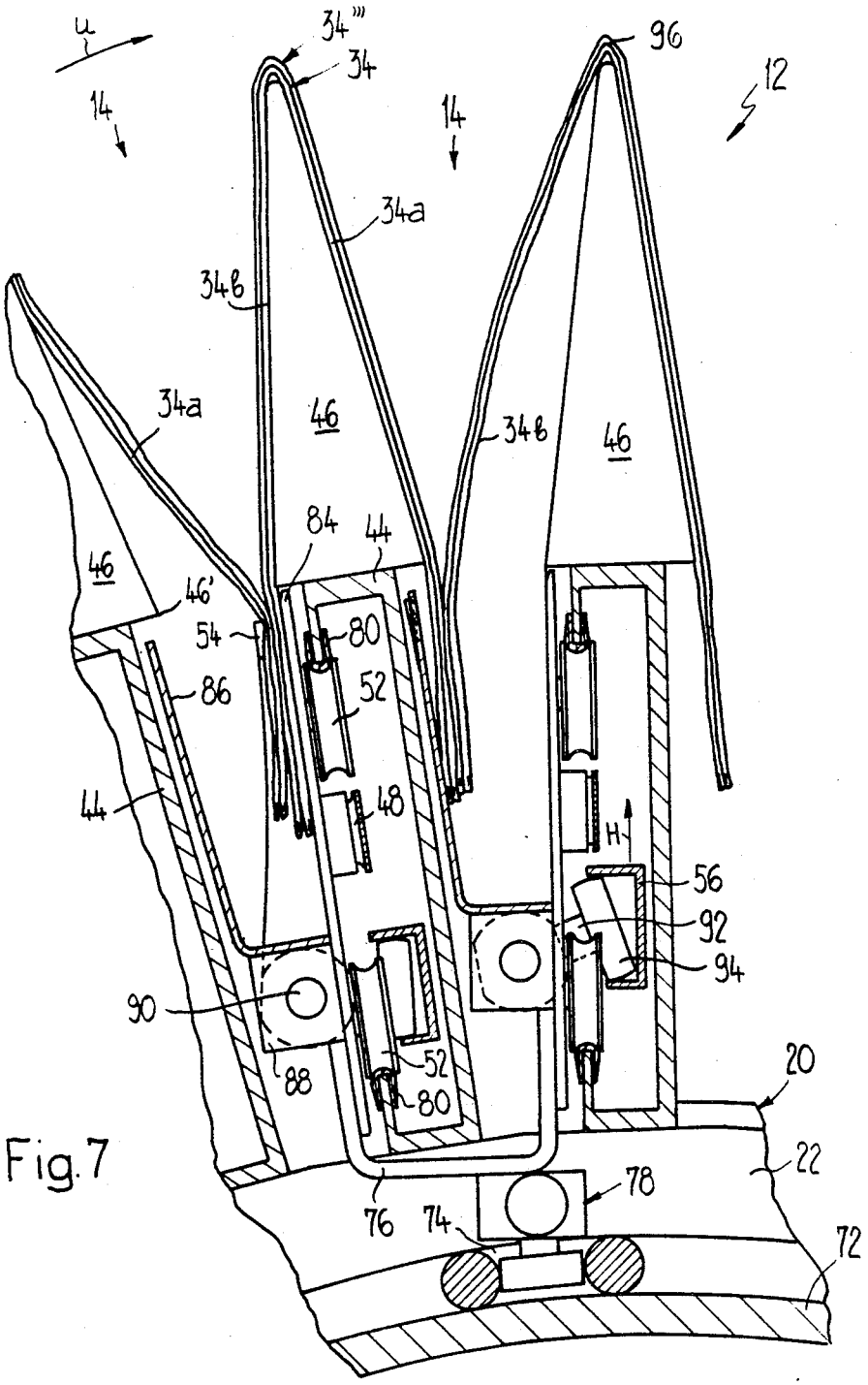

FIG. 7 shows another possible application of the drum 12, namely for the collection of folded printed sheets 34, 34'''. The layout of the drum 12 used as a collection drum corresponds to the layout of the collating drum shown in FIG. 4. For the detailed description of FIG. 7 you are therefore referred to FIG. 4. A detailed description of this collection drum 12 and the way in which it works can be found in the contemporary Swiss Patent Application No. 01 795/88-0. From the first feed conveyor 26, viewed in the direction of the arrow F shown in FIG. 1, a folded printed sheet 34 is placed astride each support 46, in the same or a similar manner as that known from, for example, EP-OS 0,208,081 or the corresponding U.S. Pat. No. 4,684,117, so that each printed sheet half **34*a* or 34*b* comes to rest in a compartment 14. Each printed sheet 34 is thus now held and conveyed by its printed sheet halves 34*a*, 34*b* by one carriage 50 disposed in different compartments 14**.

When the clamping tongues 54 of a carriage 50 close, the rear printed sheet half **34*b* of the printed sheet 34 deposited on the appropriate support 46 and the front printed sheet half 34*a* of the rear printed sheet 34, viewed in arrow direction U, are clamped. This never takes place until the two carriages 50 holding the same printed sheet 34 are running at the same speed in arrow direction F. The printed sheet 34 thus held for only a short time only by its leading printed sheet half 34*a* is thus carried along in arrow direction F and staggered in relation to the printed sheet 34 following it, so that a zigzag line of staggered printed sheets 34 is formed, and these are taken together to the second feed conveyor 26. Before the particular compartment 14 reaches the second feed conveyor 26, the appropriate clamping tongues 54 are opened, causing the staggered printed sheets 34 to be directed again in a similar manner, so that the second feed conveyor 26 can again deposit a folded printed sheet 34''' on the printed sheet 34 already deposited on the support 46. The printed sheets 34, 34''' thus lying on top of each other are now clamped by their leading and subsequently also by their rear printed sheet halves 34*a* and 34*b* respectively, and in the course of the next revolution are conveyed to the next feed conveyor 26, where a third printed sheet 34''' is placed astride the first two. In the course of the next revolutions in the direction of rotation U the printed sheets 34, 34''' thus collected are conveyed to the discharge conveyor 30, where they are seized by their folded edges 96** and conveyed away.

The opening device required for the insertion of printed sheets 34'' into a first folded printed sheet 34 (FIG. 6) and the arms which prevent the printed sheets 34, 34'' from being carried along in the opposite direction to arrow F on the return stroke of the carriages 50 can be fixed on the drum 12, and the opening device in particular must be designed in such a way that it does not act upon the printed sheets 34, 34'' during collation or collection. For example, opening devices could thus be disposed on the supports 46 in such a way that they can be swung back into the supports 46. It is, however, also conceivable for the opening devices and/or arms to be detachably disposed on the drum 12, so that the drum 12 can be changed within short changeover times to collation, insertion or collection.

It should be noted in particular that the carriages 50 and control device 58 are designed in the same way for all processing purposes. In particular, the independence of the control device 58 from the drive device 72, 74, 76, 78 permits adjustment at little expense of the closing or opening of the clamping tongues 54 as regards the movement or position of the carriages 50. For example, for insertion or collation of printed sheets 34, 34', 34'' the clamping tongues 54 can be closed when the carriages 50 are still stationary, viewed in the direction of conveyance F, while for collection the clamping tongues 54 of a carriage 50 may not be closed until this carriage 50 is running at the same speed as the leading carriage 50, viewed in the direction of the arrow U, otherwise the printed sheets 34, 34''' could be damaged. This adjustment of the opening or closing of the clamping tongues 54 can be achieved by, for example, changing the link 68. It is, however, also possible for the link 68 to be designed in such a way that its guide face can be varied. For example, provision could be made for link elements which move along the link 68, onto or off which the follower roller 66 runs.

The conveyance or return stroke of the carriages 50 can also be adjusted by swiveling the hollow shaft 18.

The drum 12 (see FIG. 1) can be made up of sections, viewed in the direction of the arrow F. It is, for example, entirely conceivable for the drum 12 shown in FIG. 1 to have such further sections attached to it, in the opposite direction to arrow F, that more than three printed sheets 34, 34', 34'', 34''' are collated, collected or inserted.

It is, of course, also conceivable for each printed sheet 34, 34', 34'', 34''' to be held fast by more than one clamping tongue 54. It is also conceivable for each feed conveyor 26 to feed in several printed sheets 34, 34', 34'' or 34''' disposed inside each other.

The rail sections 56 can also be designed, for example, in an L shape, in particular if the lever arms 92 are pretensioned in a swivel direction and are pressing the rollers 94 against the one flank of the rail sections 56.

The movement of the rail sections 56 can also be in a direction other than the radial direction H. It only has to be directed crosswise to the direction of movement of the carriages 50.

Furthermore, the feed conveyors 26 could be replaced by known feeders which feed the printed sheets 34, 34', 34'', 34''' to the supports 46 or compartments 14.

In the embodiment of the invention shown in FIGS. 1 to 7 the accommodation parts (compartments 14 and supports 46) are fixed on the drum 12. It is, however, also conceivable for saddle-type supports to be attachable to or detachable from an insertion or collating drum. The same clamping arrangements are preferably used here for the insertion, collation and collection. On the other hand, it would also be possible for a collection drum to have attachable or detachable pocket-shaped accommodation parts, or for the supports and accommodation parts to be interchangeable. It is also possible for the accommodation parts and supports to be equipped with their own clamping arrangements or clamping means which are detachable or interchangeable together with the supports or accommodation parts if necessary.

Finally, it should be mentioned that the above comments are also applicable to devices in which the supports and accommodation parts rotate along an enclosed processing line, the supports and accommodation parts being disposed, for example, on a rotary traction element which is conveyed round deflections with an essentially horizontal deflection axis.

We claim:

1. A device for the collation, insertion and collection of printed products, said device comprising:

a plurality of pocket-shaped accommodation parts for the collation or insertion of printed products travelling along a processing path, each of said accommodation parts having a lengthwise extension running crosswise to the processing path;

a plurality of saddle-shaped supports;

means for mounting the accommodation parts and the supports to the device such that the accommodation parts are spaced apart from one another to convey printed products fed into the accommodation parts at at least two feed points spaced along the processing path to a removal point, and the supports are oriented transversely to the processing path for the collection of printed products placed astride the supports at the feed points;

means for clamping printed products resting in the accommodation parts at least while the printed products are passing through a section of the processing path in which the accommodation parts are directed downwardly, and for clamping printed products astride the supports at least while the printed products are passing through a section of the processing path in which the supports are directed downwardly.

2. The invention of claim 1 wherein the mounting means detachably mounts the accommodation parts to the device.

3. The invention of claim 1 wherein the mounting means detachably mounts the supports to the device.

4. The invention of claim 1 wherein the mounting means interchangeably mounts the accommodation parts and the supports to the device.

5. The invention of claim 1 wherein the clamping means comprises a clamping member associated with a respective accommodation part and support, and wherein the clamping member is effective to releasably hold both printed products resting in the respective accommodation part and printed products astride the respective support.

6. The invention of claim 1 wherein each of the accommodation parts is associated with a respective support; wherein the clamping means comprises a plurality of clamping members, each associated with a respective accommodation part and support; and wherein each clamping member is effective to releasably hold both printed products resting in the respective accommodatin part and printed products astride the respective support.

7. The invention of claim 1 or 5 or 6 wherein the accommodation parts and the supports alternate along the processing path.

8. The invention of claim 1 or 5 or 6 wherein the mounting means mounts each of the supports to a respective one of the accommodation parts.

9. The invention of claim 8 wherein the mounting means detachably mounts each of the supports to the respective accommodation part.

10. The invention of claim 1 or 5 or 6 wherein the clamping means comprises means for conveying printed products along the accommodation parts and supports.

11. The invention of claim 10 wherein the moving means comprises means for supporting the accommodation parts and the supports for rotation about a common, substantially horizontal axis of rotation such that the lengthwise extents of the accommodation parts and supports extend substantially parallel to the rotation axis; and wherein the clamping means clamps printed products at least in a lower half of rotational positions of the accommodation parts and the supports about the axis of rotation.

12. The invention of claim 11 wherein the conveying means comprises means for driving portions of the clamping means such that during a revolution about the axis of rotation the driven portions of the clamping means carry out a conveyance stroke and a return stroke in the direction of the lengthwise extents of the accommodation parts and supports.

13. The invention of claim 12 wherein the clamping means comprises a plurality of clamps and means for opening and closing the clamps independently of the driving means.

14. The invention of claim 1 wherein the clamping means comprises a plurality of clamping member each of which is movable between an open and a closed position; and wherein each of the clamping memebers is covered by a respective one of the supports when the clamping member is in the open positions.

15. The invention of claim 5 or 6 wherein each of the clamping members is movable between an open and a closed position and wherein each of the clamping members is covered by the respective support when the clamping member is in the open position.

* * * * *